United States Patent [19]

Katoh

[11] Patent Number: 4,565,330

[45] Date of Patent: Jan. 21, 1986

[54] SHREDDING APPARATUS

[75] Inventor: Hiroharu Katoh, Tokyo, Japan

[73] Assignee: Yoshin Giken Co., Ltd., Joetsu, Japan

[21] Appl. No.: 555,939

[22] Filed: Nov. 29, 1983

[30] Foreign Application Priority Data

Nov. 30, 1982 [JP] Japan ..... 57-181019[U]

[51] Int. Cl.[4] ..... B02C 18/22

[52] U.S. Cl. ..... 241/236; 241/243; 241/293

[58] Field of Search ..... 241/236, 222, 243, 293, 241/294, 295, 101.7

[56] References Cited

U.S. PATENT DOCUMENTS 1,045,763 11/1912 Whiting ..... 241/243
4,260,115 4/1981 Hatanaka ..... 241/236

FOREIGN PATENT DOCUMENTS 58-119845 8/1983 Japan .
298253 11/1965 Netherlands ..... 241/236
52909 8/1933 Norway ..... 241/236

*Primary Examiner*—Mark Rosenbaum
*Attorney, Agent, or Firm*—Merchant, Gould, Smith, Edell, Welter & Schmidt

[57] ABSTRACT

A shredding apparatus is disclosed, which comprises rotary cutting disks and back plates. The rotary cutting disks each have peripheral edges serving as blades. The rotary cutting disks serve to shred sheets in the direction in which they are withdrawn. The rotary cutting disks each have large tooth portions formed on the outer periphery at a uniform circumferential spacing for co-operation with a back surface of the associated back plate to cut the sheets in the direction perpendicular to the direction of their withdrawal, they also each have small tooth portions formed on the outer periphery between adjacent large tooth portions, the small tooth portions being co-operative with the back surfaces of the associated back plates to compress chips produced as a result of shredding.

13 Claims, 6 Drawing Figures

SHREDDING APPARATUS

BACKGROUND OF THE INVENTION

This invention relates to a shredding apparatus for shredding unnecessary sheets, e.g., unnecessary documents, drawings, films, etc., into fine chips.

The shredding apparatus commonly termed shredder can desirably shred unnecessary sheets into as fine chips as possible. This is so because the finer the produced chips are, the more it is difficult to reproduce the record on the shredded sheets, that is, the more convenient it is to keep the record confidential.

Japanese Utility Model Disclosure No. 58-119,845 discloses a shredder which can shred unnecessary sheets in their longitudinal and lateral directions into fine chips. The shredder disclosed has a plurality of pairs of rotary cutting disks, with the rotary cutting disks of each pair being rotated in opposite directions as they come together. As the rotary cutting disks of the individual pairs are rotated in opposite directions, unnecessary sheets are cut in the direction, in which the sheets are fed into the shredder. Each rotary cutting disk has a plurality of teeth formed in a spaced-apart relationship to one another and at a uniform spacing on its outer periphery, the teeth each having an axial or lateral edge serving as a blade. The shredder also has back plates each having a back surface, which is substantially complementary in contour to and extends around and in a close proximity relation to the "addendum" surface of the associated rotary cutting disk. Thus, with the rotation of the individual rotary cutting disks their teeth cut the unnecessary sheets in the lateral direction thereof, i.e., in the direction perpendicular to the direction in which the sheets are fed, in co-operation with the back surfaces of their associated back plates. The rotary cutting disks further each have radial projections formed on the periphery between adjacent teeth. These radial projections serve to prevent the produced chips from being caught between axially adjacent rotary cutting disks.

The prior art shredder as described above has the following drawbacks. With the rotation of the pairs of rotary cutting disks, the unnecessary sheets being fed or supplied thereto are withdrawn into between two rows of rotary cutting disks in a shredding arrangement with each other to be shredded therebetween. The withdrawal of the supplied sheets are chiefly effected by the teeth of the individual rotary cutting disks. However, since the teeth are formed in a spaced-apart relationship around the circumference of the rotary cutting disks, with withdrawal forces acting on the sheets are produced intermittently. Therefore, it is liable that the sheets fail to be withdrawn smoothly, with the result that the sheets are shredded not smoothly but roughly and unsatisfactorily. This difficiency is particularly pronounced in case when a large number of sheets are withdrawn at a time.

The intermittent withdrawal of sheets given rise to another drawback that a pulsating load is applied to the drive shafts of the rotary cutting disks, this increasing the burden on a drive motor for driving the drive shafts.

SUMMARY OF THE INVENTION

An object of the invention is to provide a shredder apparatus, which permits smooth withdrawal of sheets to be shredded and satisfactory shredding of the sheets as well as permitting the reduction of load of the shredding action.

According to the invention, there is provided a shredding apparatus, which comprises a drive shaft for driven for rotation, a plurality of rotary cutting disks mounted on the drive shaft at predetermined intervals along said drive shaft, each of the rotary cutting disks having a plurality of large tooth portions formed on the outer periphery at a uniform circumferential spacing, small tooth portions formed on the outer periphery between adjacent ones of the large tooth portions, and two peripheral edges serving as blades, the large tooth portions each including a plurality of large teeth each having an axial edge serving as blade, the small tooth portions each including a plurality of small teeth and cutting means for co-operating with the rotary cutting disks to shred sheets in longitudinal and lateral directions thereof, the cutting means having blades for co-operating with the peripheral edges of the rotary cutting disks to cut the sheets in a direction in which the sheets are withdrawn into between the rotary cutting disks and cutting means, and back surfaces extending around and in a close proximity relation to the addendum surface of the respective rotary cutting disks for co-operation with the large tooth portions of the rotary cutting disks to cut the sheets in the perpendicular direction to the withdrawal direction.

One feature of the invention resides in that each of the rotary cutting disks has the large and small tooth portions formed on the outer periphery such that these tooth portions can exert continuous withdrawal forces to be sheets to be shredded. That is, these tooth portions of the rotary cutting disks can catch and withdraw the sheets continuously. The sheets thus can be withdrawn smoothly, so that not only they can be shredded satisfactoriy but also it is possible to make the load on the drive shafts driving the rotary cutting disks uniform, thus reducing the burden on the drive motor for driving the drive shafts.

Another feature of the invention is that the large tooth portions of the rotary cutting disks each includes a plurality of, e.g., three, large teeth, so that the sheets can be reliably cut in the direction perpendicular to the withdrawal direction by one of the teeth in each large tooth portion.

Further, in one form of the invention the back surfaces of the cutting means each has a curved surface portion extending around and in a close proximity relation to the addendum surface of the associated rotary cutting disk. Thus, chips that are produced as a result of shredding can be comprssed between the addendum surfaces of the rotary cutting disks and the curved surface portions of the associated back surfaces, thus reducing the volume of the chips.

This means that the weight of the chips that can be collected in the chip correction bucket of the shredding apparatus is increased for the same volume of the bucket. In other words, for the same weight of chips to be collected the volume of the bucket can be reduced, thus permitting the size reduction of the bucket, and hence the shredding apparatus.

Further, while the chips are being compressed between the small tooth portions of the rotary cutting disks and the curved surface portions of the back surfaces, the small teeth wedge into and urge the chips, so that the chips can be reliably raked out and removed from the back surfaces with the rotation of the rotary cutting disks without any possibility for the chips to get caught between the rotary cutting disks and back surfaces.

DETAILED DESCRIPTION OF THE PREFERRED EMBODIMENT

Figure 1:
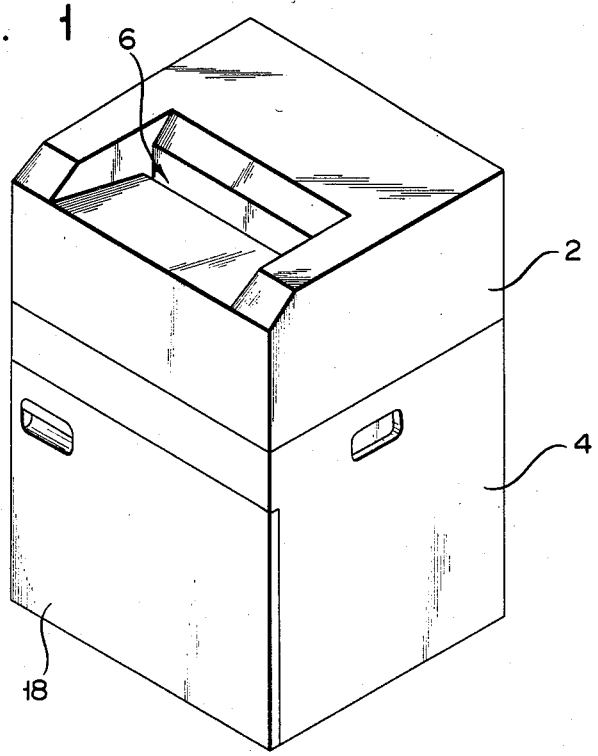
FIG. 1 is a perspective view showing an embodiment of the shredder apparatus according to the invention.
Figure 2:
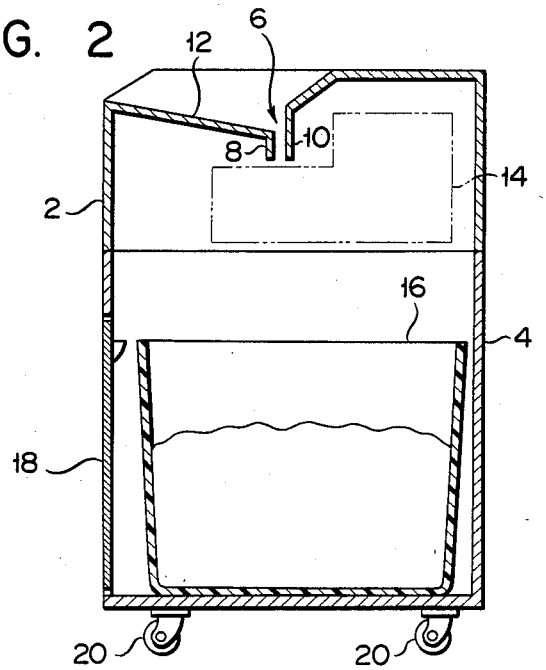
FIG. 2 is a sectional view of the shredder apparatus shown in FIG. 1.

Referring now to FIG. 1, there is wholly shown an embodiment of the shredding apparatus according to the invention. As is shown, it has an upper and lower housing 2 and 4. As shown in FIGS. 1 and 2, the top of the upper housing 2 has an inlet 6, through which unnecessary sheets such as documents, drawings and films to be shredded are inserted. The inlet 6 is defined between a pair of downwardly extending guides 8 and 10. The guide 8 is part a plate constituting the upper housing 2, and it terminates at the upper end in an insertion guide 12 which is downwardly inclined toward the inlet 6. The other guide 10 also terminates at the upper end in the top of the upper housing 2. Sheets or the like inserted through the inlet 6 are shredded by a shredder mechanism 14 to be described later in detail, which is accommodated in the upper housing 2, into numerous fine chips which are allowed to fall down.

The lower housing 4, as shown in FIG. 2, accommodates a chip collector vessel or bucket 16 made of a synthetic resin, in which chips falling from the shredder mechanism 14 are received. The bucket 16 can be taken out of and inserted into the lower housing 2 by opening a door 18 provided on the front of the lower housing 4. The lower housing 4 has four casters provided on its underside to facilitate the displacement of the shredder apparatus.

Figure 3:
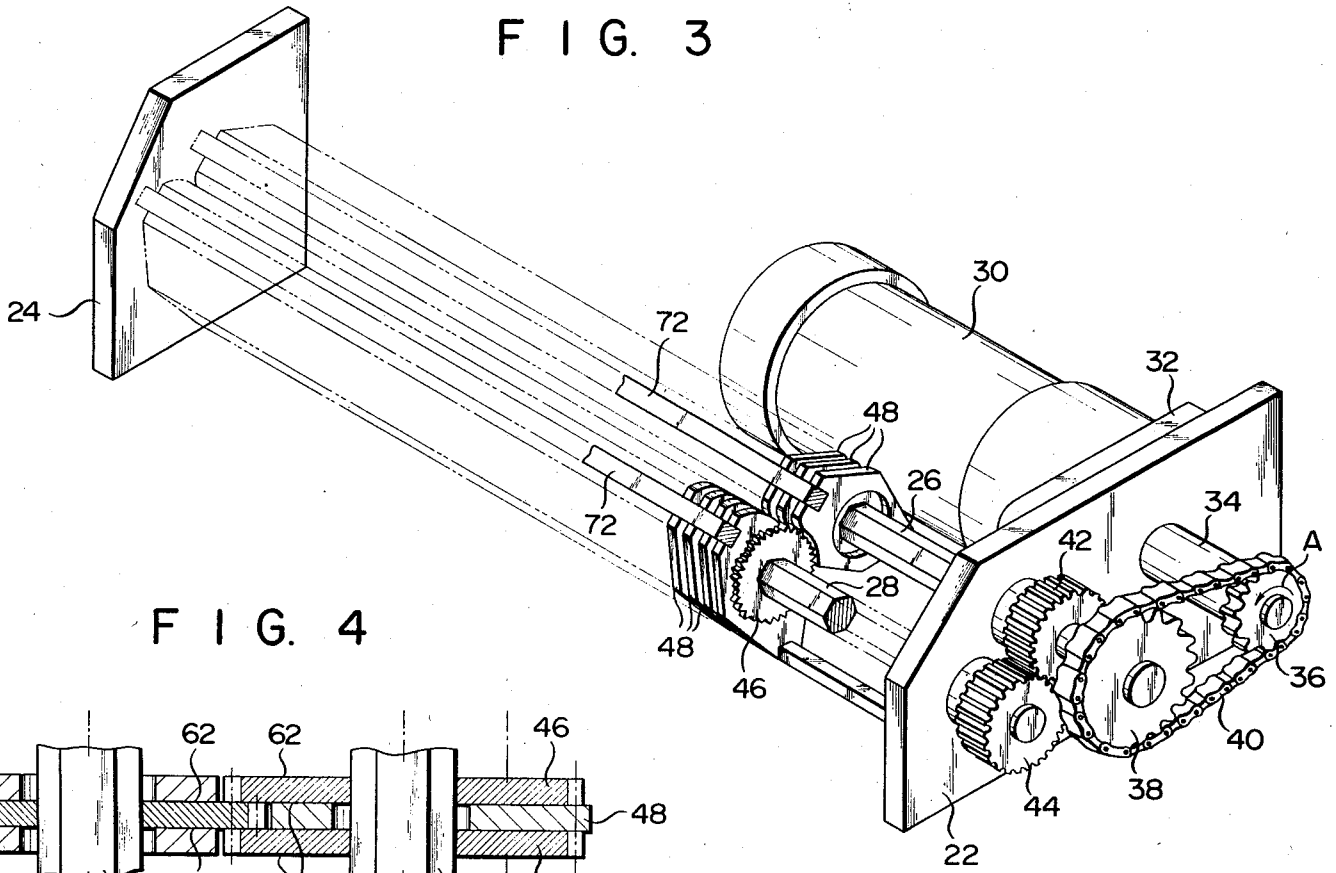
FIG. 3 is a perspective view showing a shredder mechanism in the shredder apparatus.

FIG. 3 shows the specific construction of the shredding mechanism 14 noted above. The mechanism 14 includes supporting plates 22 and 24, which are secured to the upper housing 2 in a spaced-apart relationship in the direction along the inlet 6 of the shredding apparatus. A pair of parallel drive shafts 26 and 28 spaced apart a predetermined distance, extend between and are rotatably supported in the supporting plates 22 and 24. The inlet 6 noted above is found above the drive shafts 26 and 28. The drive shafts 26 and 28 are rotated in opposite directions by an electric motor 30. The motor 30 is mounted by a mounting plate 32 on the inner surface of the supporting plate 22. A shaft 34 of the motor 30 penetrates the supporting plate 22, and it has a small diameter sprocket 36 secured to its end projecting from the supporting plate 22. The drive shafts 26 and 28 also penetrate the supporting plate 22. The drive shaft 26 has a large diameter sprocket 38 secured to its end projecting from the supporting plate 22. An endless chain 40 is passed round the sprockets 36 and 38. The drive shaft 26 has a spur gear 42 secured to its portion extending between the supporting plate 22 and sprocket 38. The other drive shaft 28 also has a spur gear 44 secured to its portion corresponding to the spur gear 42 and in mesh therewith. With the rotation of the shaft 34 of the motor 30 in the direction of arrow A in FIG. 3, the drive shafts 26 and 28 are thus rotated in opposite directions via the sprocket 36, chain 40, sprocket 38 and spur gears 42 and 44. The drive shaft 26 is rotated in the counterclockwise direction in FIG. 3, and the drive shaft 28 is rotated in the clockwise direction.

The portions of the drive shafts 26 and 28 extending between the supporting plates 22 and 24 have a hexagonal sectional profile. These hexagonal drive shafts 26 and 28 each carry rotary cutting disks 46 and back plates 48 in an alternate arrangement in the axial direction.

Figure 5:
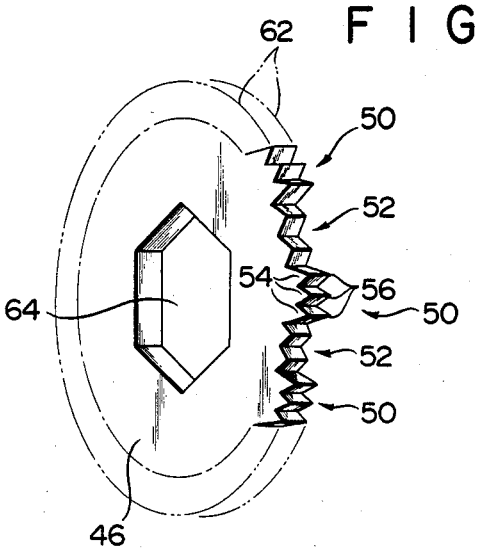
FIG. 5 is a fragmentary perpsective view showing a rotary cutting disk of the shredder mechanism.
Figure 6:
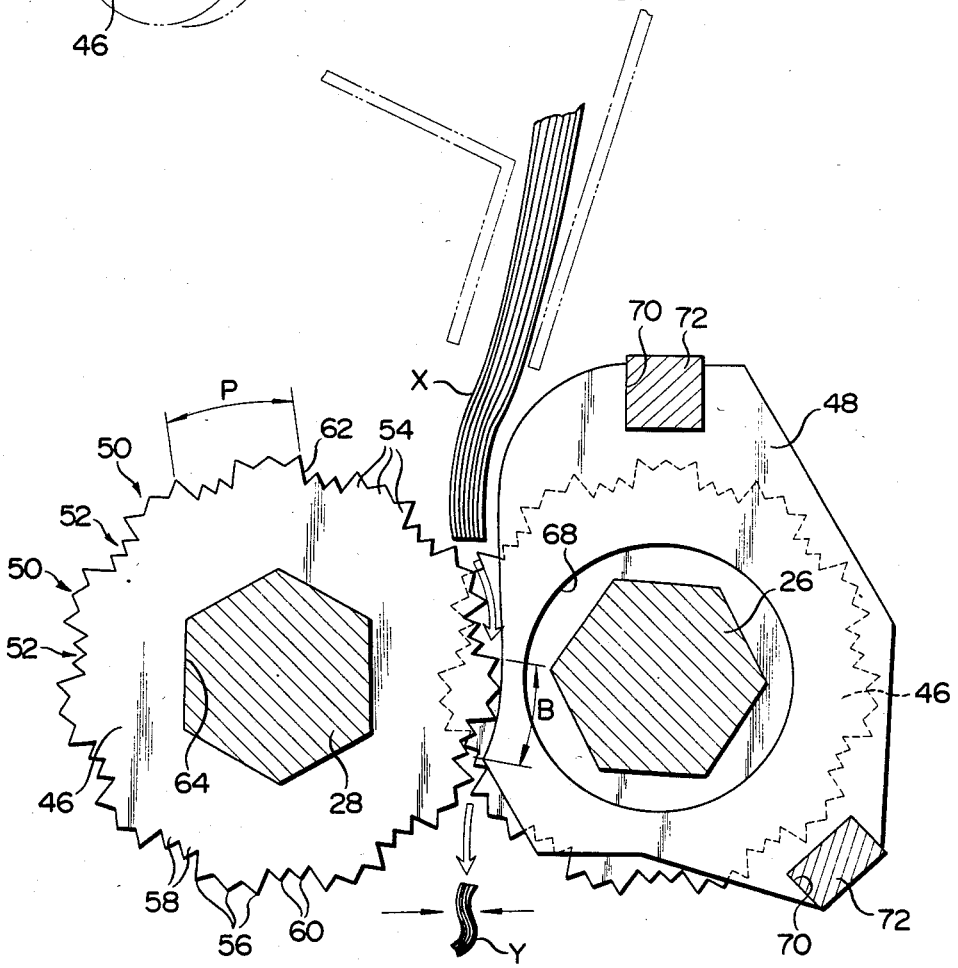
FIG. 6 is a vertical sectional view showing part of the shredder mechanism.

The rotary cutting disk 46 and back plate 48 have respective configurations as shown in detail in FIGS. 5 and 6. The rotary cutting disk 46 has a plurality of large tooth portions 50 formed on its outer periphery at a uniform circumferential spacing. It also has small tooth portions 52 formed on the outer periphery between adjacent ones of the large tooth portions 50. The alternate large and small tooth portions 50 and 52 are formed continuously with one another. The large tooth portions 50 each consist of a plurality of e.g., three, large teeth 54 having a triangular sectional profile. Each of the large teeth 54 has an axial edge 56 which serves as a blade. The small tooth portions 52, like the large teeth portions 52, each have a plurality of, e.g., two, small teeth 58 having a triangular sectional profile. Each of the small teeth 58 has an axial edge 60 which may again serve as a blade. It is to noted that in this embodiment the whole depth of the large teeth 54 is approximately three times the whole depth of the small teeth 58. The rotary cutting disk 46 further has two peripheral edges 62 serving as blades. Further, it has a central hexagonal opening or hole 64, which is complementary to the sectional profile of and can be penetrated by the hexagonal drive shaft 26 or 28. The rotary cutting disks 46 which are fittedly carried by the drive shart 26 or 28 are thus rotated in unison therewith.

The back plate 48 has a smaller thickness or axial dimension than the rotary cutting disk 46. As shown in FIG. 6, it has a back surface 66, which co-operates with the large tooth portions 50 of the associated rotary cutting disk 46 mounted on the other drive shaft. In the lower part of the back surface it has a curved surface portion B, which extends around and in a close proximity relation to the outer periphery or addendum surface of the associated rotary cutting disk 46 with a slight gap defined therewith. The back plate 48 has a central circular opening or hole having a greater diameter than the diameter of the drive shaft 26 or 28. It also has two peripheral notches 70 formed on the periphery other than the back surface 66.

The rotary cutting disks 46 and back plates 48 are mounted on the drive shafts 26 and 28 in the manner described hereinunder in detail.

On the drive shaft 26, the pertinent rotary cutting disks 46 and back plates 48 are mounted in an alternate arrangement in the axial direction. The back plates 48 are mounted stationarily such that their back surfaces 66 face the other drive shaft 28. Their like notches 70 are in register with one another in the axial direction and receive corresponding coupling bars 72 such that these bars 72 extend parallel to the drive shafts 26 and 28. The coupling bars 72 are secured at their opposite ends to the respective supporting plates 22 and 24. Thus, while the rotary cutting disks 46 can be rotated in unison with the drive shaft 26, the back plates 48 are held against rotation by the coupling bars 72.

Figure 4:
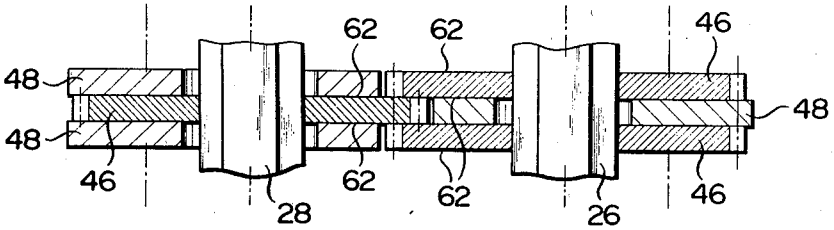
FIG. 4 is a horizontal sectional view showing part of the shredder mechanism.

Now, on the other drive shaft 28, like the drive shaft 26, the pertinent rotary cutting disks 46 and back plates 48 are mounted in an alternate arrangement in the axial direction. However, the alternate arrangement of the rotary cutting disks 46 and back plates 48 on the drive shaft 28 is axially shifted with respect to that on the drive shaft 26 by an amount corresponding to the thickness of one rotary cutting disk 46. Thus, as shown in FIG. 4, each of the rotary cutting disks 46 on the drive shaft 28 is interposed between adjacent ones of the rotary cutting disks 46 on the drive shaft 26, with its addendum surface facing the back surface 66 of the corresponding back plate 48 on the drive shaft 26 with a slight gap defined between the former and the latter. The peripheral edge 62 of the rotary cutting disks 46 on the drive shaft 28 and those of the adjacent rotary cutting disks 46 on the drive shaft 26 are rotatable in cutting relationship with one another. Of course, each of the rotary cutting disks 46 on the drive shaft 26 is interposed between adjacent ones of the rotary disks 46 on the drive shaft 28, with its addendum surface facing the back surface 66 of the corresponding back plate 48 on the drive shaft 28 with a slight gap defined between the former and the latter.

The operation of the shredding apparatus having the above construction will now be described.

It is assumed that the rotary cutting disks 46 on the drive shaft 26 and those on the drive shaft 28 are being rotated in opposite directions by the electric motor 30. In this state, when a sheet or sheets inserted through the inlet 6 reaches the shredding mechanism 14, they are caught by the large and small tooth portions 50 and 52 of the rotary cutting disks 46 on the drive shafts 26 and 28 to be withdrawn into between the rotary cutting disks 46 on the drive shaft 26 and those on the drive shaft 28, as shown in FIG. 6. The withdrawal of the sheets X at this time is effected by the large and small teeth 54 and 48 of the tooth portions 50 and 52 which are formed continuously with one another. The sheets X are thus withdrawn smoothly by continuous withdrawal forces exerted to them. Consequently, the load on the drive shats 26 and 28 rotating the rotary cutting disks 46 can be made uniform, and this has an effect of alleviating the burden on the motor 30. Since the rotary cutting disks 46 on the side of the drive shaft 26 and those on the side of the drive shaft 28 are being rotated in opposite directions with the peripheral edges 62 as blades of the former and those of the latter in the cutting relationship with one another, the withdrawn sheets X are cut or shredded in the direction of their withdrawal, i.e., in the direction perpendicular to the axial direction of the drive shafts 26 and 28 due to the fact that the peripheral edges 62 of the rotary cutting disks 46 on the two drive shafts 26 and 28 come together. The pitch of cutting in the withdrawal direction corresponds to the thickness of one rotary cutting disk 46. Concurrently with the cutting of the sheets X in the withdrawal direction, the co-operation of the large tooth portions 50 of the rotary cutting disks 46 and the back surfaces 66 of the associated back plates 48 effects cutting of the sheets X in the direction perpendicular to the withdrawal direction. Of the teeth 54 of the large tooth portion 50, the leading one in the direction of rotation of the rotary cutting disk 46 effects actual cutting of the sheets X in the perpendicular direction to the withdrawal direction. The sheets X are thus shredded in their withdrawal direction and the perpendicular direction thereto to a numerous fine chips Y. The dimension of the chips Y in the length direction thereof, i.e., in the withdrawal direction, corresponds to the pitch P of the large tooth portions 50 of the rotary cutting disks 46. The shredding of the sheets X in the two perpendicular directions noted above can be obtained satisfactorily for the sheets X are withdrawn smoothly as described before.

The chips Y produced as a result of the shredding, are compressed chiefly between the curved surface portions B of the back surfaces 66 of the back plates 48 and the small tooth portions 52 of the associated rotary cutting disks 46. Their volume is thus reduced. The small tooth portions 52 do not only effect compression of the chips Y, but their teeth 58 can also serve to rake out the chips Y with the rotation of the rotary cutting disks 46 so that the chips Y will reliably fall from the curved surface portions B of the back plates 48. There is thus no possibility for the chips Y to get caught between the rotary cutting disks 46 and back plates 48. The chips Y falling from the back surface 66 are received and collected in the bucket 16 as described before.

What is claimed is:

1. A shredding apparatus for cutting unnecessary sheets, comprising:

(a) a support;

(b) first and second rotary shafts extending in parallel and rotatably connected to the support so as to be rotated in opposite directions;

(c) a plurality of first cutting disks equidistantly mounted on the first rotary shaft and driven together with the first rotary shaft, and a plurality of second cutting disks equidistantly mounted on the second rotary shaft and driven together with the second rotary shaft, each of the cutting disks comprising:

(i) a plurality of large tooth portions equidistantly arranged on the outer circumferential surface of the associated cutting disk, wherein each large tooth portion comprises a plurality of large teeth, and wherein the tip of each large tooth is formed as a large axial blade;

(ii) a plurality of small tooth portions arranged on the outer circumferential surface of the associated cutting disk in the regions between the large tooth portions, wherein each small tooth portion comprises a plurality of small teeth; and (iii) radial blades formed at the outer peripheral edges of the associated cutting disk, wherein the outer peripheral edges of the first and second cutting disks are in sliding contact, and wherein the sheets are taken up by the large and small tooth portions in accordance with rotation of the first and second cutting disks so as to be shredded in a first direction parallel to the taking-up direction of the sheets in cooperation with the outer peripheral edges of the first and second cutting disks which slide relative to each other;

(d) a plurality of first back plates fixed against rotation relative to the support and equidistantly spaced along but not fixedly attached to the second rotary shaft, wherein each of the first back plates is disposed between a pair of second cutting disks, and wherein the sheets are shredded in a second direction perpendicular to the first direction in accordance with the cooperation between the large axial blades of the first cutting disks and the associated first back plates; and (e) a plurality of second back plates fixed against rotation relative to the support and equidistantly spaced along but not fixedly attached to the first rotary shaft, wherein each of the second back plates is disposed between a pair of first cutting disks, and wherein the sheets are shredded in a second direction perpendicular to the first direction in accordance with the cooperation between the large axial blades of the second cutting disks and the associated second back plates.

2. The shredding apparatus according to claim 1, wherein each tooth included in the large and small tooth portions of the first and second cutting disks has a triangular cross section.

3. The shredding apparatus according to claim 2, wherein the whole depth of said large teeth is approximately three times the whole depth of said small teeth.

4. The shredding apparatus according to claim 1, wherein the tip portion of each small tooth included in the small tooth portions of the cutting disks is formed as a small axial blade.

5. The shredding apparatus according to claim 1, wherein the large teeth portions each have three large teeth and the small teeth portions each have two small teeth.

6. The shredding apparatus according to claim 1, wherein the thickness or axial dimension of the back plates is slightly smaller than the corresponding dimension of said rotary cutting disks.

7. A shredding apparatus for cutting unnecessary sheets, comprising:

(a) a support;

(b) first and second rotary shafts extending in parallel and rotatably connected to the support so as to be driven in opposite directions;

(c) a plurality of first cutting disks equidistantly mounted on the first rotary shaft and driven together with the first rotary shaft, and a plurality of second cutting disks equidistantly mounted on the second rotary shaft and driven together with the second rotary shaft, each of the cutting disks comprising:

(i) a plurality of large tooth portions equidistantly arranged on the outer circumferential surface of the associated cutting disk, wherein each large tooth portion comprises a plurality of large teeth, and wherein the tip of each large tooth is formed as a large axial blade;

(ii) a plurality of small tooth portions arranged on the outer circumferential surface of the associated cutting disk in the regions between the large tooth portions, wherein each small tooth portion comprises a plurality of small teeth; and (iii) radial blades formed at the outer peripheral edges of the associated cutting disk, wherein the outer peripheral edges of the first and second cutting disks are in sliding contact, and wherein the sheets are taken up by the large and small tooth portions in accordance with rotation of the first and second cutting disks so as to be shredded in a first direction parallel to the taking-up direction of the sheets in cooperation with the outer peripheral edges of the first and second cutting disks which slide relative to each other;

(d) a plurality of first spacers disposed between adjacent second cutting disks and fixedly connected to the support, each first spacer having a first back surface facing the tooth surface of the associated first cutting disk to shred the sheets in a second direction perpendicular to the first direction in cooperation with the large tooth portions of the associated first cutting disk, and a curved second back surface contiguous to the first back surface, the second back surface serving to compress the shredded sheets in cooperation with the small tooth portions of the associated first cutting disk; and (e) a plurality of second spacers disposed between adjacent first cutting disks and fixedly connected to the support, each second spacer having a first back surface facing the tooth surface of the associated second cutting disk to shred the sheets in the second direction in cooperation with the large tooth portions of the associated second cutting disk, and a curved second back surface contiguous to the first back surface, the second back surface serving to compress the shredded sheets in cooperation with the small tooth portions of the associated second cutting disk.

8. The shredding apparatus according to claim 7, wherein the second back surface of each of the first and second spacers is curved to provide a constant distance between the center of rotation of the cooperating cutting disk and any optional point of the second back surface of the associated spacer.

9. The shredding apparatus according to claim 8, wherein the radius of curvature of the second back surface of each of the first and second spacers is equal to that of the outer circle of the cutting disk.

10. The shredding apparatus according to claim 7, wherein each tooth included in the large and small tooth portions of the first and second cutting disks has a triangular cross section.

11. The shredding apparatus according to claim 7, wherein the tip portion of each small tooth is formed as a small axial blade.

12. The shredding apparatus according to claim 7, wherein the large teeth portions each have three large teeth and the small teeth portions each have the two small teeth.

13. The shredding apparatus according to claim 7, wherein the thickness or axial dimension of the back plates is slightly smaller than the corresponding dimension of said rotary cutting disks.

* * * * *